United States Patent [19]

Howells

[11] Patent Number: 4,938,284

[45] Date of Patent: Jul. 3, 1990

[54] HEAT EXCHANGER

[75] Inventor: David R. Howells, Llanelli, Wales

[73] Assignee: Austin Rover Group Limited, United Kingdom

[21] Appl. No.: 100,270

[22] Filed: Sep. 23, 1987

[30] Foreign Application Priority Data

Oct. 21, 1986 [GB] United Kingdom ..... 8625142

[51] Int. Cl.[5] ..... F28F 9/26

[52] U.S. Cl. ..... 165/149; 165/153; 165/175

[58] Field of Search ..... 165/149, 153, 173, 175

[56] References Cited

U.S. PATENT DOCUMENTS

| | | | |
|---|---|---|---|
| 2,899,177 | 8/1959 | Harris et al. | 165/153 |
| 3,113,615 | 12/1963 | Huggins | 165/149 |
| 3,265,126 | 8/1966 | Donaldson | 165/140 |
| 3,866,675 | 2/1975 | Bardon et al. | 165/173 |

FOREIGN PATENT DOCUMENTS

| | | | |
|---|---|---|---|
| 860359 | 2/1961 | United Kingdom | 165/175 |
| 2098313A | 11/1982 | United Kingdom | 165/149 |

*Primary Examiner*—Albert J. Makay
*Assistant Examiner*—Allen J. Flanigan
*Attorney, Agent, or Firm*—Thomas J. Greer, Jr.

[57] ABSTRACT

A heat exchanger is provided in which two header tanks (11,12) are structurally connected together by two spaced apart casing members (15,16) therebeing a number of fluid conduits (13) to provide a fluid transfer connection therebetween. Each of the header tanks (11,12) includes a plate member (18) a side wall member (19) which defines in combination with the plate member (18) a fluid manifold each end of which is closed by a respective end cap (20A,20B,21A,21B). Each of the end caps (20A, 20B,21A,21B) includes means (25) used during assembly as an assembly aid. A further feature of the invention is the use of extruded material for several of the structural components.

13 Claims, 3 Drawing Sheets

HEAT EXCHANGER

This invention relates to heat exchangers and in particular to heat exchangers in which air is used to cool a fluid medium passing through the heat exchanger such as an oil cooler, air to air intercooler or water radiator of a motor vehicle.

It is known from GB No. 2098313 to provide a heat exchanger in which two so called header tanks are connected together by a number of fluid conduits each of which is provided with means to improve the heat transfer from the respective conduit to the air which is passed between the conduits, one of the header tanks being arranged to receive a supply of liquid to be cooled and the other arranged to supply liquid, that has been cooled by passing through the conduits, to a device requiring cooled liquid.

According to this invention there is provided a heat exchanger comprising a first tank; a second tank; a heat exchanger core interposed between said first and second tanks; a first casing member extending between said first and second tanks; a second casing member extending between said first and second tanks, the heat exchanger core including a number of fluid transfer conduits to provide a fluid transfer connection between said first and second tanks, each of said conduits being separated from adjacent conduits by an open structured heat transfer media, each of said tanks including a plate member defining a number of apertures each aperture having one end of one of said fluid conduits secured therein, an extruded side wall member connected to said plate member to define therewith a fluid manifold and a pair of end caps to close the ends of said manifold wherein one of said end caps associated with said first tank defines a fluid inlet means and one of said end caps associated with said second tank defines a fluid outlet means.

This has the advantage that the side wall members are cheap to manufacture and that if the height of the heat exchanger needs to be changed this can be easily accomplished.

Advantageously, each of said side wall members is made from extruded aluminium alloy.

The use of aluminium has the advantage of low weight.

Preferably, each of said side wall members is substantially U or C-shaped in cross-section.

Preferably, each plate member may be a substantially flat member, the longitudinal edges of which are engaged and secured in complementary grooves in the cooperating side wall member.

This has the advantage that the side wall members do not require clamping in position during assembly.

Alternatively, each plate member may be a substantially flat member, the longitudinal edges of which are turned up and secured to the inner surface of the cooperating side wall member.

Preferably, each of the casing members is an extruded casing member having a groove extending along its length.

This has the advantage that the width of the heat exchanger can be easily accomplished. Advantageously, said first and second casing members are connected to the first and second tanks by means of the end caps. The end caps may be adapted for connection to said casing members by the provision of a tongue portion for engagement with the groove in each of the casing members, in which case each of said casing members may be locally deformed during assembly to grip said locating means thereby holding the assembled parts of the heat exchanger in position before they are secured together.

This has the advantage that during assembly the heat exchanger is self supporting prior to final securing.

Preferably, at least one end cap has bracket means formed integrally therewith used to connect the heat exchanger in use to a support.

According to a second aspect of the invention there is provided a method of assembling a heat exchanger as claimed in claim 1 the method including the steps of:

fitting the end caps to the first and second casings;

stacking alternately the fluid conduits and the heat transfer media to form a sub-assembled heat exchanger core;

fitting the plate members and the side wall members to the sub-assembled heat exchanger core;

fitting the sub-assembled heat exchanger core complete with plate members and side walls to the second casing member so that the end caps become engaged with the lower ends of the manifolds defined by the side wall members and the plate members;

fitting the first casing member complete with end caps to the sub-assembled heat exchanger core so that the end caps become engaged with the upper ends of the manifolds defined by the side wall members and the plate members;

urging the first and second casing members towards each other therebny forcing the end caps fully into engagement with the manifolds and then placing the assembled but unsecured heat exchanger into a furnace where it is brought to a sufficiently high temperature to produce brazing of the pre-assembled parts.

This has the advantage of simple assembly and hence reduced costs.

The invention will now be described by way of example with reference to the accompanying drawings of which;

Figure 1:
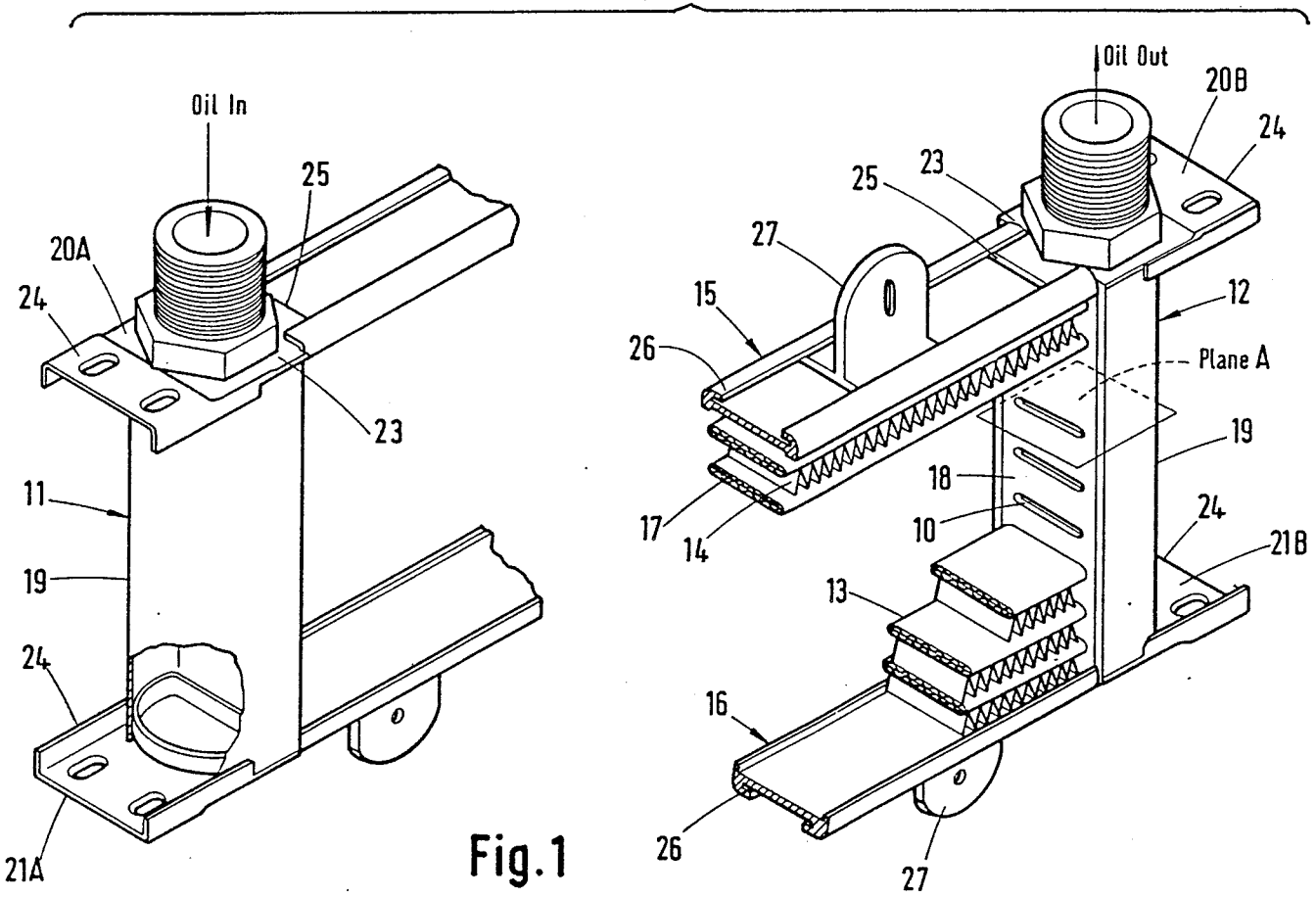
FIG. 1 is a pictorial part section through a heat exchanger according to the invention.
Figure 2:
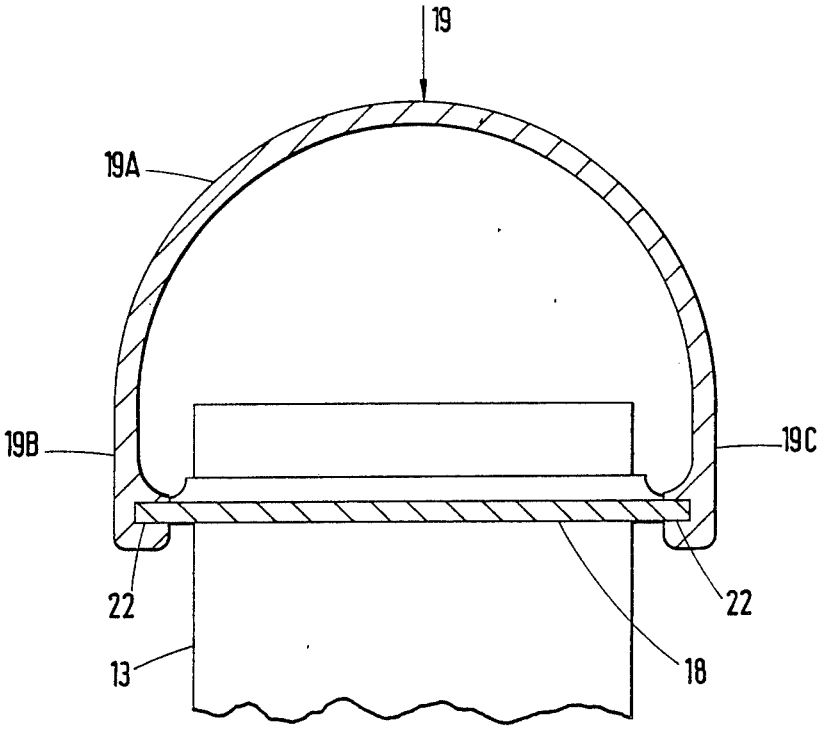
FIG. 2 is a scrap-section on the plane A of FIG. 1 showing a first embodiment of a header tank according to the invention.
Figure 3:
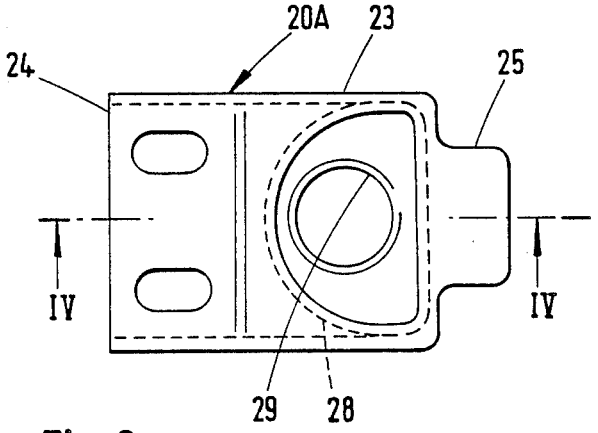
FIG. 3 is a plan view of an end cap forming part of the header tank according to the invention.
Figure 4:
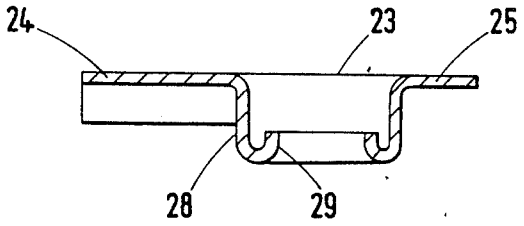
FIG. 4 is a cross section on the line IV—IV on FIG. 3.

With reference to FIGS. 1 to 4 there is shown a heat exchanger according to a first embodiment of the invention having a first header tank 11, a second header tank 12, a heat exchanger core extending between the first and second header tanks 11, 12 and first and second casing members in the form of extruded top and bottom rails 15 and 16.

The heat exchanger core includes a number of fluid transfer conduits in the form of oval tubes 13 each of which provides a fluid transfer connection between the first and second header tanks 11 and 12 and is separated from adjacent tubes 13 by an open structured heat transfer media in the form of a serpentine airway 14.

Each of the serpentine airways 14 is made from a highly conductive material such as aluminium or one of its alloys and is joined to the tubes 13 between which it is interposed to improve the transfer of heat from the respective tubes 13 into the air which, in use, flows through the serpentine airway 14.

Each of the tubes 13 is coated before assembly with a brazing material used to secure it upon assembly. A turbulator 17 is fitted into each of the tubes 13 and is secured to the inner surface of each of the tubes 13. The turbulators 17 are provided to increase the strength of the tubes 13 and also to improve the transfer of heat from the fluid passing through each tube 13 into the wall of that tube 13.

Each of the header tanks 11, 12 includes a plate member in the form of a tube plate 18, a side wall member 19 in the form of a substantially U-shaped extrusion connected to said tube plate 18 to define a fluid manifold, each end of each fluid manifold being closed by a respective end cap 20A,B, 21A,B.

Each side wall member 19 is a substantially U-shaped aluminium alloy extrusion and has a semi-circular portion 19A and two flat leg portions 19B, 19C joined together by said semi-circular portion 19A. Each of said leg portions 19B, 19C has an inwardly facing groove 22 in it near to its free end.

Each of the tube plates 18 is a substantially flat pressed component having two longitudinal edges and has a number of apertures 10 in it into each of which is located and secured one end of one of the tubes 13. Each tube plate 18 is coated before assembly with a brazing material and flux to enable it to be secured upon assembly to the co-operating side wall 19.

Each of the tube plates 18 is engaged upon assembly with the grooves 22 in the respective side wall member 19 with which it co-operates, before being secured in position by brazing.

Each of the end caps 20A,B, 21A,B has a peripheral flange 23 and a tapered spigot 28 to locate it in the end of the fluid manifold with which it is engaged.

Each of the end caps 20a,B 21A,B is pressed from a sheet material which has been coated with a brazing material used during assembly to secure the respective end cap 20A,B, 21A,B in position and is extended at one position to provide a bracket means 24 and at another position to provide a location means in the form of a tongue 25.

The bracket means 24 are used to connect, in use, the heat exchanger to some support structure such as part of a body of a motor vehicle.

The end cap 20A is provided with inlet means 29 to connect the respective tank 11 of which it forms a part to a supply of oil to be cooled from an engine (not shown) and the end cap 20B is similarly provided with outlet means to connect the respective tank 12 of which it forms a part with the engine (not shown) which requires a supply of oil that has been cooled.

Each of the rails 15, 16 has a groove 26 into which is engaged a respective one of the tongues 25, the tongues 25 being secured during assembly by brazing.

Each of the end caps 20A,B 21A,B is engaged and secured both the one of the rails 15,16 and to one of the header tanks 11,12 there being engagement of the tongues 25 with the grooves 26 and engagement of the tapered spigots 28 with the manifolds. The end caps 20A,B 21A,B therefore provide a rigid mechanical connection between the rails 15,16 and the header tanks 11,12

The groove 26 in each of the rails 15, 16 is also used to connect at least one substantially T-shaped bracket 27 to each of the rails 15, 16 and hence to the heat exchanger.

Each of the brackets 27 is engaged and slid along the groove 26 in which it is engaged to a desired position prior to the engagement and brazing of the end caps 20A,B, 21A,B and is secured in that position by brazing at the same time as the end caps are brazed to the rails 15,16.

The oval tubes 13, the rails 15, 16, the side walls 19 and the brackets 27 are all produced by cutting from a length of extruded material of the desired cross-sectional shape a piece of extruded metal of suitable length. The width of the heat exchanger can therefore be easily altered by simply changing the length of the material cut to form the rails 15, 16 and the tubes 13.

The height of the heat exchanger can also be altered by changing the length of the material cut to form the side walls 19 but in this case it is also necessary to produce longer tube plates 18 with more apertures 10 punched in them to accommodate the greater number of tubes 13 that would be required.

To assemble the heat exchanger the brackets 27 are first slid into the grooves 26 in the top and bottom rails 15 and 16 and then the end caps 20A, 20B and 21A, 21B are fitted to the top and bottem rails 15 and 16, the tongue 25 of each end cap 20A,20B,21A,21B being inserted into the groove 26, the top and bottom rails 15 and 16 are then staked to mechanically hold the tongues 25 in the grooves 26.

The heat exchanger core is then sub-assembled, firstly each of the tubes 13 is fitted each with one of the turbulators 17 and then to complete the sub-assembly the tubes 13 and the serpentine airways 14 are alternately stacked on a slave clamp (not shown) until the correct number of tubes for the heat exchanger being built are present.

The next stage is to fit the tube plates 18 and the side wall members 19 to the sub-assembled heat exchanger core.

Firstly, the ends of the tubes 13 are engaged with the apertures 10 in the tube plates 18 and then the side wall members 19 are slid into engagement with the tube plates 18, the inwardly facing grooves 22 of the side wall members 19 being engaged with the longitudinal edges of the tube plates 18.

The bottom rail 16 complete with end caps 21A,21B is then placed upon a final assembly jig (not shown) and the bottom most serpentine airway 14 is placed on top of the bottom rail 16.

The sub-assembled heat exchanger core complete with tube plates 18 and side walls 19 is then placed on top of the bottom airway 14 so that the spigots 28 of the end caps 21A,21B become engaged with the lower ends of the manifolds defined by the side wall members 19 and the tube plates 18.

The top rail 15 complete with end caps 20A,20B is then brought into position, the spigots 28 of the end caps 21A,21B being engaged with the upper ends of the manifolds defined by the side wall members 19 and the tube plates 18.

The top and bottom rails 15,16 are then urged towards each other by the clamping effect of the final assembly jig thereby forcing the spigots 28 of the end caps 20A,20B,21A,21B fully into engagement with the manifolds.

The final assembly jig and completed but as yet not secured, heat exchanger is then placed in a furnace where it is brought to a sufficiently high temperature to produce brazing of the pre-assembled parts.

Finally, the heat exchanger is removed from the furnace and allowed to cool before being cleaned and pressure tested.

In a second embodiment of the invention the heat exchanger is substantially as hereinbefore described with the exception of the construction of the header tanks.

Figure 5:
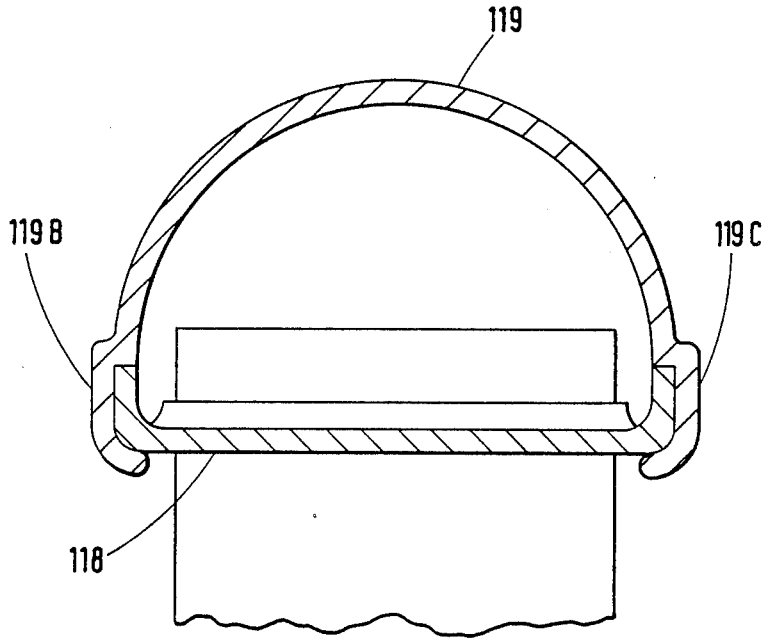
FIG. 5 is a view similar to FIG. 2 but showing a second embodiment of a header tank according to the invention.

In this second embodiment as shown in FIG. 5 the longitudinal edges of the tube plates 118 are turned up and the legs 119B,119C of the side wall member 119 are arranged to grip the respective tube plate 118.

Although as hereinbefore described the end caps, are push fitted into the end of the fluid manifolds it is envisaged that external end caps could alternatively be used to close the ends of the fluid manifolds and in this case the end caps would fit outside the tube plate and side wall.

It will also be appreciated that if the end caps are fitted to the ends of the manifolds with sufficient interference then it is possible to remove the assembly jig before heating the heat exchanger in the furnace.

I claim:

1. A heat exchanger of brazed aluminum construction comprising: a first tank; a second tank; a heat exchanger core interposed between said first and second tanks; a first casing member extending between said first and second tanks; a second casing member extending between said first and second tanks, the heat exchanger core including a number of fluid transfer conduits to provide a fluid transfer connection between said first and second tanks, each of said conduits being separated from adjacent conduits by an open structured heat transfer media, each of said tanks including a plate member defining a number of apertures, each aperture having one end of one of said fluid conduits secured therein, a side wall member connected to said plate member to define therewith a fluid manifold, at least one component from the group comprising said first casing member, said second casing member, and said side wall member extruded and formed with a pair of grooves, each groove having an open end and a closed end opposite said open end, and in which the distance between said open ends is different from the distance between said closed ends, and in which another component of the heat exchanger, other than said one component formed with said grooves, is formed with edges which lie within and are held by said grooves.

2. A heat exchanger as claimed in claim 1 in which each of said side wall members is substantially U-shaped in cross-section.

3. A heat exchanger as claimed in claim 1 in which each of said side wall members is substantially C-shaped in cross-section.

4. A heat exchanger as claimed in claim 2 in which each plate member is a substantially flat member, the longitudinal edges of which are engaged and secured in complimentary grooves in the co-operating side wall member.

5. A heat exchanger as claimed in claim 2 in which each plate member is a substantially flat member having longitudinal edges which are turned up and secured to said closed ends of said grooves of the co-operating side wall member.

6. A heat exchanger as claimed in claim 1 in which said open ends of the grooves are closer together than said closed ends.

7. A heat exchanger as claimed in claim 1 in which each of the grooves of at least one of said casing members hold at least one bracket engaged therewith to connect the heat exchanger in use to a support structure.

8. A heat exchanger as claimed in claim 5 in which each of the grooves has at least one bracket engaged therewith to connect the heat exchanger in use to a support structure.

9. A heat exchanger as claimed in claim 1 in which said first and second casing members are connected to the first and second tanks by means of the end caps to close the ends of said manifolds.

10. A heat exchanger as claimed in claim 9 in which each of the end caps is adapted for connection to said casing members by the provision of a tongue portion for engagement with the groove in each of the casing members.

11. A heat exchanger as claimed in claim 10 in which each of the end caps has a spigot portion that is press fitted into the end of the manifold to which the end cap is fitted.

12. A heat exchanger as claimed in claim 9 in which at least one end cap has bracket means formed integrally therewith used to connect the heat exchanger in use to a support.

13. A method of assembling a heat exchanger, the heat exchanger comprising a first tank; a second tank; a heat exchanger core interposed between said first and second tanks; a first casing member extending between said first and second tanks; a second casing member extending between said first and second tanks, the heat exchanger core including a number of fluid transfer conduits to provide a fluid transfer connection between said first and second tanks, each of said conduits being separated from adjacent conduits by an open structured heat transfer media, each of said tanks including a plate member defining a number of apertures, each aperature having one end of one of said fluid conduits secured therein, a side wall member connected to said plate member to define therewith a fluid manifold, and a pair of end caps to close the ends of said manifold wherein one of said end caps defines a fluid inlet means and a further one of said end caps defines a fluid outlet means, the method including the steps of:

fitting the end caps to the first and second casing members; stacking alternately the fluid conduits and the heat transfer media to form a sub-assembled heat exchanger core;

fitting the plate members and the side wall members to the sub-assembled heat exchanger core;

fitting the sub-assembled heat exchanger core complete with plate members and side walls to the second casing member so that the end caps become engaged with the lower ends of the manifolds defined by the side wall members and the plate members;

fitting the first casing member complete with end caps to the sub-assembled heat exchanger core so that the end caps become engaged with the upper ends of the manifolds defined by the side wall members and the plate members; urging the first and second casing members towards each other thereby forcing the end caps fully into engagement with the manifolds and then placing the assembled but unsecured heat exchanger into a furnace where it is brought to a sufficiently high temperature to effect brazing of the pre-assembled parts.

* * * * *